US006937024B2

(12) United States Patent
Kim

(10) Patent No.: US 6,937,024 B2
(45) Date of Patent: Aug. 30, 2005

(54) MULTIPLE SYSTEM FOR INSPECTING THE OPERATION OF AN IGNITION SYSTEM IN VEHICLES

(75) Inventor: Sung Hoon Kim, 598-9 Sujung-5-dong, Dong-gu, Busan (KR)

(73) Assignees: Busan Techno-Park and Sung Hoon Kim, Busan (KR); Sung Hoon Kim, Busan (KR)

( * ) Notice: Subject to any disclaimer, the term of this patent is extended or adjusted under 35 U.S.C. 154(b) by 0 days.

(21) Appl. No.: 10/731,945

(22) Filed: Dec. 9, 2003

(65) Prior Publication Data

US 2005/0093549 A1 May 5, 2005

(30) Foreign Application Priority Data

Oct. 29, 2003 (KR) ..... 03-75851

(51) Int. Cl.[7] ..... F02P 17/00

(52) U.S. Cl. ..... 324/384; 324/399

(58) Field of Search ..... 324/378, 380, 324/388, 393, 402, 384, 399

(56) References Cited

U.S. PATENT DOCUMENTS 6,204,770 B1 * 3/2001 Johnson ..... 340/660
6,426,626 B1 * 7/2002 Kravis ..... 324/388
6,606,551 B2 * 8/2003 Ito ..... 701/114

* cited by examiner

*Primary Examiner*—Anjan Deb
*Assistant Examiner*—Walter Benson
(74) *Attorney, Agent, or Firm*—Lee, Hong, Degerman, Kang & Schmadeka

(57) ABSTRACT

Disclosed is a multiple test system for use in vehicles for inspecting the operation of an ignition system. A high voltage waveform is applied to an ignition plug and detected by a Hall sensor. The multiple test system compares the detected voltage waveform with a reference value, and calculates maximum, minimum and mean values of the voltage waveform. Ignition energy is inspected by a user for determining if a component needs to be replaced.

7 Claims, 6 Drawing Sheets

MULTIPLE SYSTEM FOR INSPECTING THE OPERATION OF AN IGNITION SYSTEM IN VEHICLES

BACKGROUND OF THE INVENTION

1. Field of the Invention

The present invention relates to a system for inspecting the operation of an ignition system for vehicles, in which upon application of a high voltage to an ignition plug, a Hall sensor detects the waveform of a high voltage generated from the ignition plug so that the high voltage can be compared with a reference voltage having a predetermined waveform. Then, a user confirms an output result, and based upon the operation of the ignition system, readily determines the time point to replace an aged part.

2. Background of the Related Art

An Electronic Control Unit (Hereinafter, referred to as 'ECU') performs control based upon conditions of an engine by receiving inputs from a variety of sensors and switches. After a vehicle has been run successively, gasoline mileage drops and the quantity of exhaust gas increases unlike a new vehicle. Such a problem is caused by mechanical abrasion of an engine as well as poor maintenance of various units. Among them, the ignition system is most frequently troubled and most important. Therefore, the ignition system needs periodical inspection and maintenance after a predetermined time period. However, a test system is also required to perform correct inspection.

A conventional test system includes a tester for examining only a gap of the ignition plug, in which a unit for generating a high voltage of at least a predetermined value is installed. While the engine is not operated after assembly of the ignition plug, the conventional test system examines only the gap of the ignition plug based upon characteristics that the internal resistance is varied according to the gap of the ignition plug. However, such a conventional technology can inspect only the ignition plug and thus cannot inspect an overall ignition system.

Further, there is also a conventional tester capable of examining the performance of an ignition coil to inspect the insulating ability of the ignition coil. However, this tester can examine a single performance only and thus there is a limitation against inspection to the overall ignition system.

As another example of the prior art, there is a test system for measuring ignition energy which functions to generate forced ignition and thus can be inspected even if a vehicle is stopped. In inspection of ignition energy, this test system can determine the intensity of a second high voltage flowing through the ignition plug based upon the intensity of a voltage applied to both ends. However, in this conventional test system, the engine is stopped before an inspection device is placed between the ignition plug and a cable and then started again to inspect ignition energy, thereby complicating usage and prolonging associated inspection time. Therefore, this test system is used only in a laboratory without being applied at site.

Although various types of test systems have been made to inspect the ignition system as described above, they are complicated and expensive to be applied at site and thus rarely used at site. Therefore, the ignition system is inspected and repaired based upon feeling of mechanics. However, since mechanics show a variety of qualities and abilities, a mechanic of little experience can make erroneous judgment during inspection, which leads to poor confidence of customers and sometimes even misunderstanding.

SUMMARY OF THE INVENTION

The present invention has been made to solve the foregoing problems and it is therefore an object of the present invention to provide a test system which is connected to an ignition plug via a Hall sensor to measure the rotation speed of an engine, the voltage and current of an electric generator, the resistance of the ignition plug and the compression pressure of a cylinder as well as an ignition system based upon a high voltage waveform generated from the ignition plug in order to determine whether or not the ignition plug functions normally, and if it is determined that the ignition plug malfunctions, notifies a mechanic or user of it to repair or replace a corresponding component in order to ensure normal operation to a vehicle.

According to an aspect of the present invention for realizing the above object, a multiple test system for use with vehicles measures ignition energy, engine rotation speed or RPM, voltage/current (of an electric generator), resistance and cylinder compression pressure in DLI and distributor type engines having an ECU, a power transistor and an ignition coil.

The invention is not restricted to general distributor type engines but applied to those engines each mounted with a Distributor Less Ignition (DLI) ignition system which comprises first and second ignition coils 10 and 11, which are replaced for a distributor, so that two cylinders are ignited synchronous at the end of compression and exhaust strokes.

Further, the present invention is applicable to an engine mounted with an apparatus adopting diode-distributed ignition in the LDI ignition system.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to a multiple test system for use in vehicles according to a preferred embodiment of the present invention, examples of which are illustrated in the accompanying drawings.

FIGS. 1A through 1D illustrate a multiple test system for use in vehicles according to a preferred embodiment of the present invention, which is connected to components of a vehicle to inspect the same.

Figure 1A:
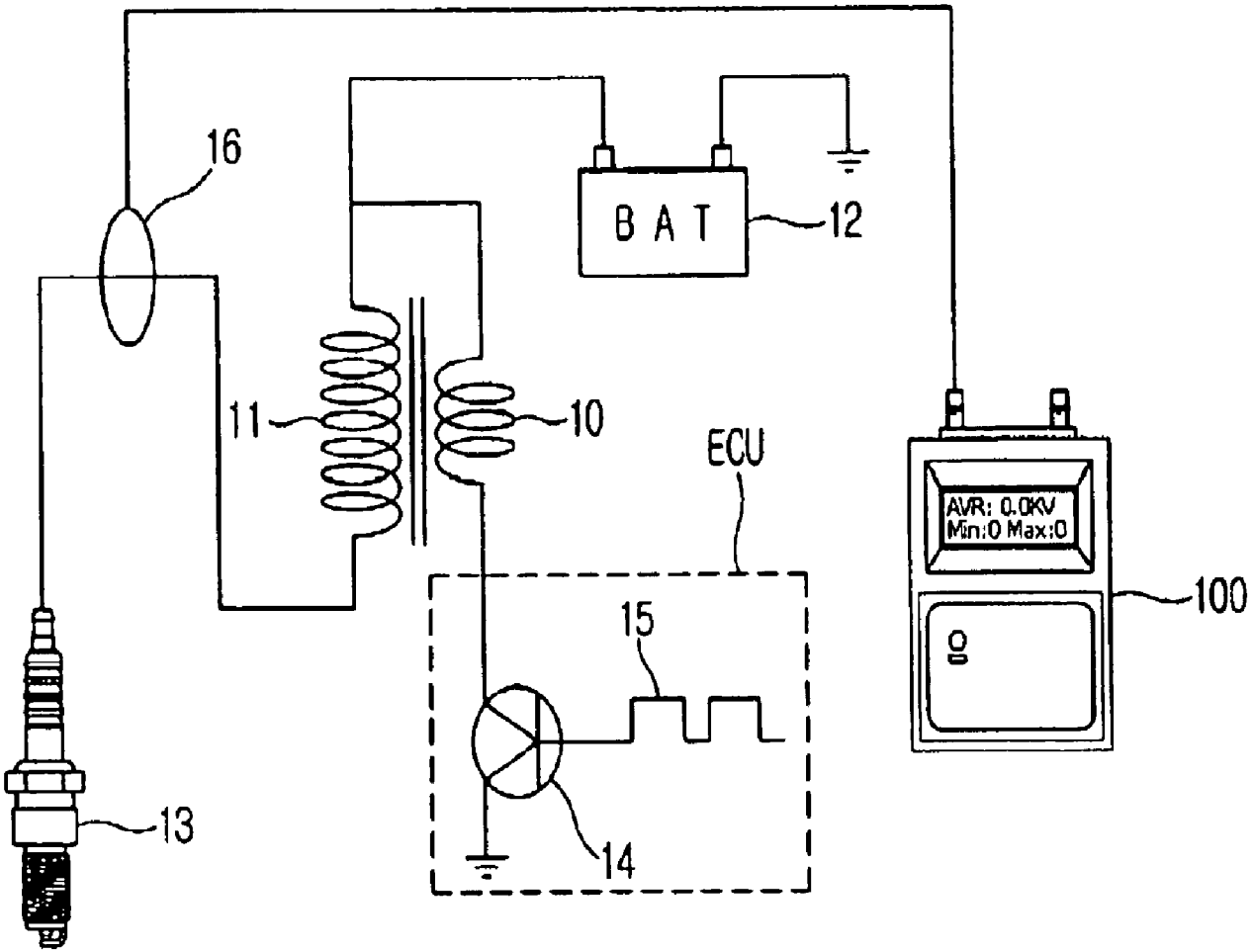
FIGS. 1A through 1D illustrate a multiple test system for use in vehicles according to a preferred embodiment of the present invention, which is connected to components of a vehicle to inspect the same.

First referring to FIG. 1A which illustrates a test for measuring ignition energy and engine rotation speed, a battery 12 supplies a first ignition coil 10 with a first or low voltage of about 200 to 300V. The low voltage is induced to a second ignition coil 11 which converts the low voltage into a high or output voltage of about 20,000 to 25,000V through mutual induction. After elevated from the low voltage through the ignition coils, the high voltage is transferred through a high voltage cable to an ignition plug 13, which then creates sparking ignition so that compression and exhaust strokes of a vehicle can be carried out simultaneously with the starting of the vehicle.

Figure 3A:
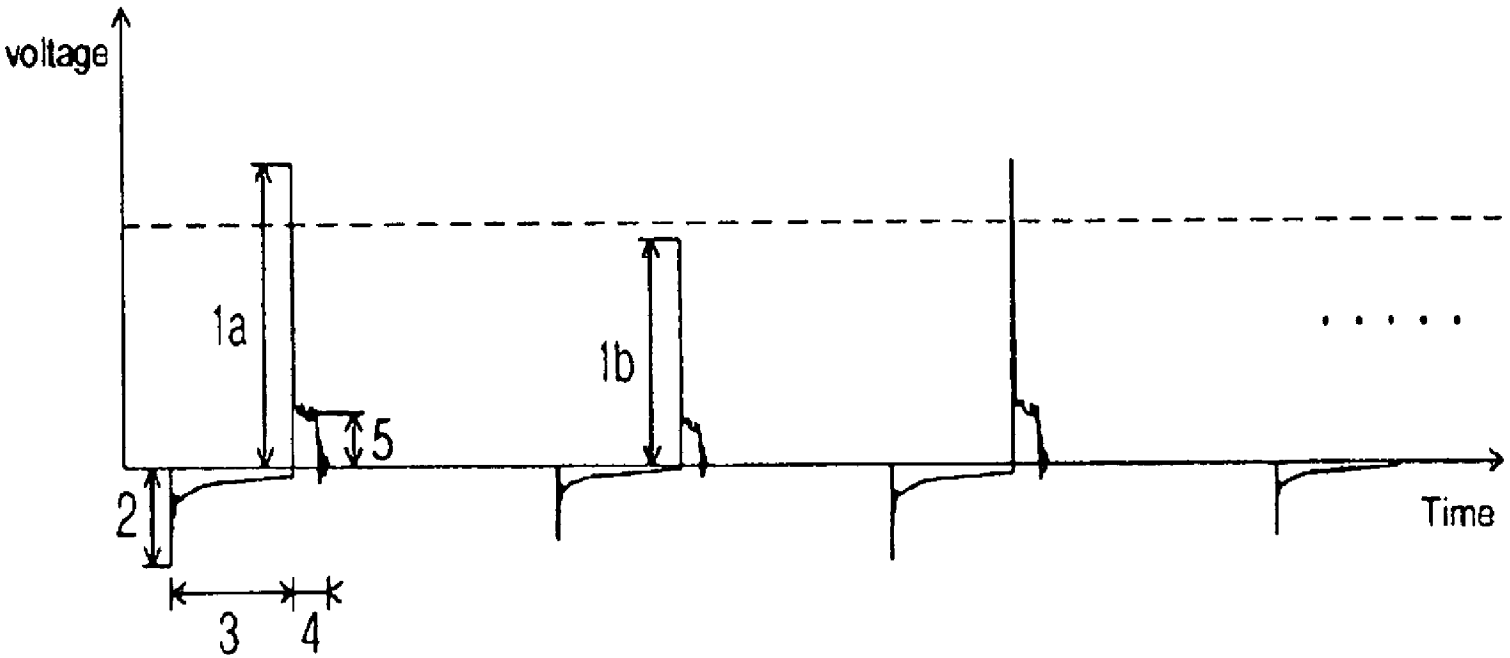
FIG. 3A illustrates a voltage waveform which is generated from an ignition plug according to the invention.

The ignition plug 13 generates a high voltage waveform as shown in FIG. 3A. The high voltage waveform shown in FIG. 3A is simplified from repeated waves, and analyzed into several waves as follows: A first high peak voltage 1*a* is formed in the high voltage waveform of FIG. 3A during the compression stroke of an engine cylinder. During the compression stroke, internal resistance rises to generate high voltage so that the first peak voltage 1*a* is formed higher. The first peak voltage 1*a* is followed by a second peak voltage 1*b* shown during the exhaust stroke. During the exhaust stroke, internal resistance is reduced to lower the intensity of voltage so that the height of the waveform is formed lower. The peak voltages 1*a* and 1*b* are about 7 through 13KV in a normal state, and may be varied according to conditions of a combustion chamber and an ignition system and compression ratio.

In FIG. 3A, the peak voltage 1*a* is preceded by a waveform section 2 designating reverse current which is generated during a short initial stage. A current-flowing time period 3 is in practice for about 3 to 4 ms but may be varied according to the voltage of the battery 12 flowing through the first ignition coil 10. A discharge time period 4 after the peak voltages 1*a* and 1*b* means a discharge time of second voltage and is normally for about 1.5 msec. The discharge time period is varied according to the gap of the plug, compression ratio and the polluted state of the plug tip. A discharge voltage 5 observed after the peak voltage is normally for about 1.2 to 2.0KV, and varied according to external conditions such as the discharge time period 4.

Further an Electronic Control Unit (ECU) comprises a power transistor 14 and the first ignition coil 10 connected to the power transistor 14. The low voltage supplied to the first ignition coil 10 is transferred to the power transistor 14 so that the engine cylinder can carry out the compression and exhaust strokes according to a square waveform 15 shown in FIG. 1A. The square waveform 15 has elevated sections and lowered sections so that two engine cylinders connected to one ignition system can simultaneously carry out compression and exhaust strokes. One of the engine cylinders connected to the ignition plug 13 is driven in unison with the other one of the engine cylinders according to a DLI technique of the invention. That is, the ignition system (such as the ignition plug, the ignition coil and an ignition cable) as shown in FIG. 1A is connected to both the engine cylinders.

In order to measure ignition energy, a Hall sensor 16 of the test system of the invention is placed in an intermediate portion of a high voltage cable connecting between the ignition plug 13 and the ignition coils 10 and 11. A user of the test system 100 connected to the Hall sensor 16 can inspect the operating condition of the ignition system via a display of the test system 100. The test system 100 can inspect the ignition energy of another cable which is connected to the other one of the engine cylinders by using the Hall sensor 16 according to above fashion. As described above, the DLI technique of the invention using the Hall sensor 16 reads voltage instead of current so that all the cylinders can be inspected without stopping the engine.

Figure 2:
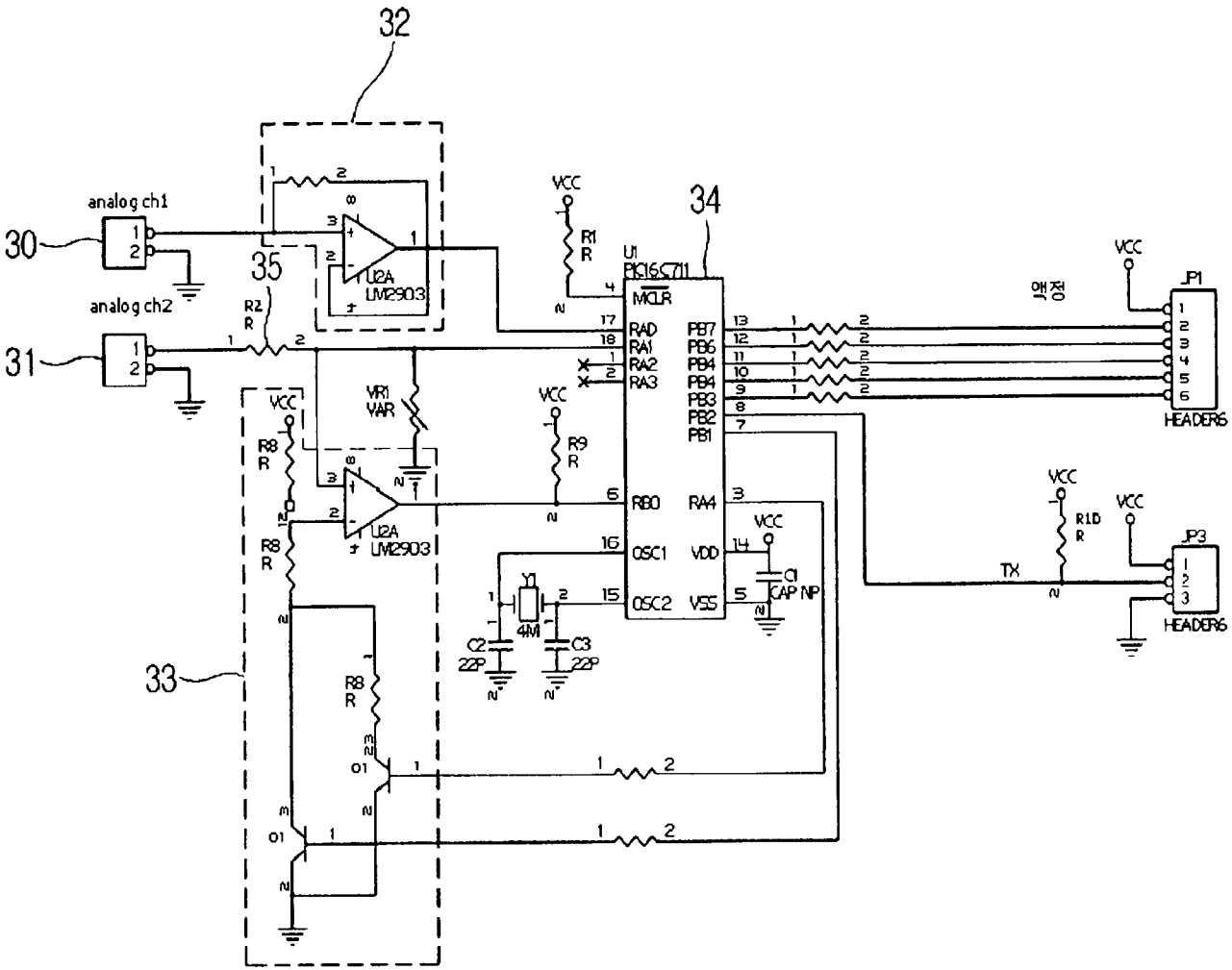
FIG. 2 is an internal circuit layout of the multiple test system of the invention.

FIG. 2 is an internal circuit layout of the multiple test system of the invention.

As shown in FIG. 2, the multiple test system of the invention comprises a first analogue signal receiving section 30 and a second analogue signal receiving section 31. The second analogue signal receiving section 31 is used to measure ignition energy and engine rotation speed, and connected to the Hall sensor 16 to receive analogue signals. That is, the second analogue signal receiving section 31 is connected to the Hall sensor 16 to receive an input for a high voltage waveform of an analogue form which is generated from the ignition plug 13.

The second analogue signal receiving section 31 is connected to the Hall sensor to receiving a high voltage waveform which is generated from the ignition plug 13. The high voltage waveform is converted from a high voltage level to a measurable moderate voltage level as shown in FIG. 3A while passing through a succeeding resistance 35. The high voltage waveform as shown in FIG. 3A generated from the ignition plug 13 is directly inputted into an internal microcomputer or micom 34. The high voltage waveform as shown in FIG. 3A generated from the ignition plug 13 is directly inputted into the internal micom 34. Since it is impossible to read a digital value from an analogue waveform, the micom 34 converts the high voltage waveform from an analogue form into a digital form with an A/D converter therein so that a digital value can be read from the high voltage waveform. Further, the micom 34 converts an analogue signal into a digital signal, wherein the analogue signal is inputted into the first analogue signal receiving section 30 and then amplified in a non-reversing section 32 which is drawn with a dotted line.

After passing through the second analogue signal receiving section 31 and then the resistance 35, the high voltage waveform is inputted into a positive (+) terminal of an OP amplifier in a comparator 33 which is designated with a dotted line in FIG. 2. The comparator 33 compares an input into the positive (+) terminal of the OP amplifier with that in a negative (−) terminal of the OP amplifier, and outputs an ON signal if the input into the positive (+) terminal is higher than that in the negative (−) terminal, but outputs an OFF signal if the input into the negative (−) terminal is higher than that in the positive (+) terminal. The input into the negative (−) terminal is a reference voltage which is used to compare the high voltage waveform.

Referring to dotted portions in FIG. 2, a predetermined voltage Vcc is applied to a dotted circuit having resistances so that the predetermined voltage Vcc is distributed into resistances via distributive law under the control of the micom 34. The reference voltage is set according to distribution and then inputted into the comparator 33. Alternatively, a predetermined value of external voltage may be set as the reference voltage which is directly inputted into the comparator 33.

If the engine is ignited according to DLI technique, a second reference voltage is set in a pulse detection circuit and inputted into the comparator 33. According to a DLI ignition technique, pulses are generated in such a fashion with one pulse per revolution of the engine, in which high and low values alternate with each other. Further, in the DLI ignition technique, the micom 34 sets the reference voltage of the pulse detection circuit to selectively measure those ones of the pulses having the high value so that the RPM and the intensity of the high voltage are detected based upon only the high voltage waveform without inspecting a low voltage waveform. As a result, the reference voltages are set in two stages as above. Alternatively, where the engine is ignited with a typical distributor, the pulse detection circuit sets a first reference voltage in order to detect the low voltage waveform.

Figure 3B:
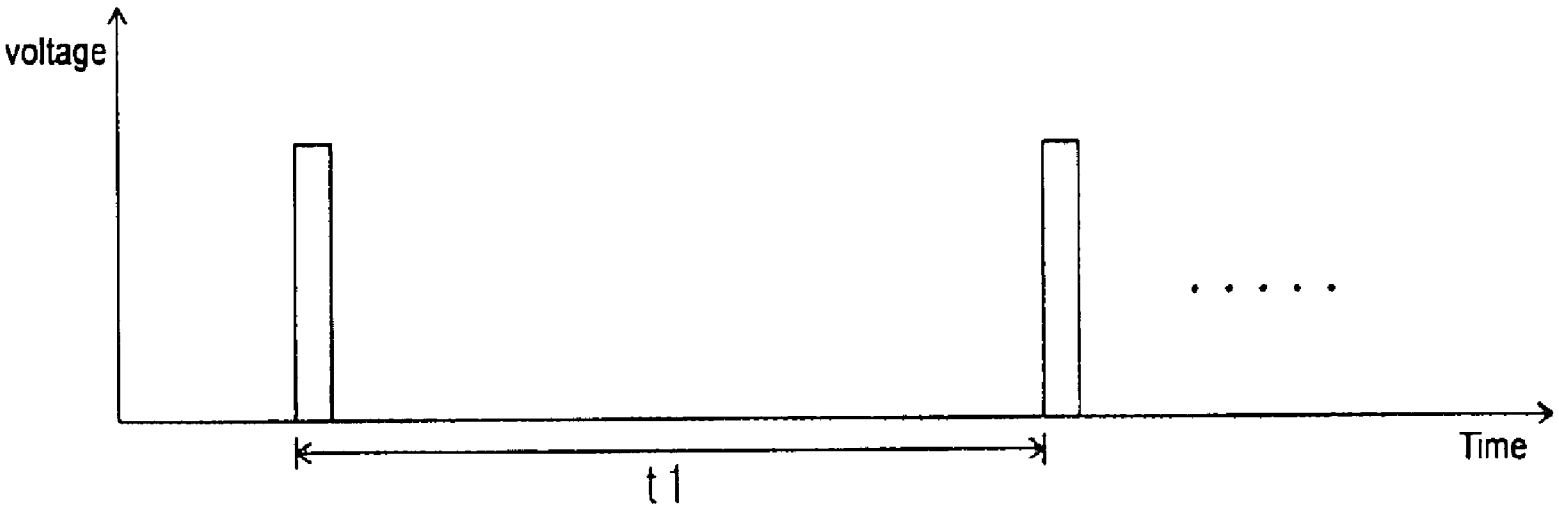
FIG. 3B illustrates a square wave obtained according to the voltage waveform in FIG. 3A.

The comparator 33 compares the high voltage waveform, as shown in FIG. 3A, which is inputted into the positive (+) terminal of the OP amplifier with the second reference voltage which is inputted into the negative (−) terminal so as to output the square wave as shown in FIG. 3B. That is, if the high voltage waveform shown in FIG. 3A is higher than the second reference voltage, the comparator 33 outputs the ON signal during a time period that the high voltage waveform is generated higher than the second reference voltage with respect to the time axis. On the contrary, if the high voltage waveform is lower than the second reference voltage, the comparator 33 outputs the OFF signal during a corresponding time period. Further, the pulse width of the square wave shown in FIG. 3B is outputted wider as the reference voltage is lowered. As a result, the comparator 33 compares the second reference voltage with the high voltage waveform so that the ON and OFF signals are repeated as shown in FIG. 3B to generated the square wave of a predetermined period which is then inputted into the micom 34.

The micom 34 analyzes the high voltage waveform which is generated during the time period that the ON signal is generated or the square wave as shown in FIG. 3B is generated. In order to analyze the high voltage waveform, the micom 34 reads the digitalized value of the waveform with respect to the time period, in which the ON signal is generated in FIG. 3B, based upon the waveform which is converted into the digital form through A/D conversion. The micom 34 analyzes values of the high voltage waveform which is read as above to calculate maximum, minimum and mean values. As shown in FIGS. 3A and 3B, the high voltage waveform and the square wave are repeated according to a predetermined period. The invention calculates maximum, minimum and mean values about high voltage waveform in one period where square waves of the above type are repeated ten times. Further, the micom 34 measures the continuous of one time period t1 among the repeated pulses of the square waves shown in FIG. 3B in order to calculated engine rotation speed per minute based upon engine RPM during t1. Therefore, the micom 34 calculates the digital signals as above while controlling the overall operation of the system.

The maximum, minimum and mean values of the high voltage and the engine rotation speed (RPM) which are calculated in the micom 34 as above are outputted via a liquid crystal display section of the multiple test system 100. The liquid crystal display section of the multiple test system shown in FIG. 1A outputs the maximum, minimum and mean values of the high voltage, in which the liquid crystal display section presents different outputs according to the calculated values. According to the values presented in the liquid crystal display section, the user can directly confirm ignition energy and engine rotation speed in order to judge whether the vehicle operates normally.

The multiple test system of the invention can measure the compression pressure of an engine cylinder by using a pressure sensor attached to the ignition plug. As shown in FIG. 1C, both ends of the ignition plug internally mounted with the pressure sensor are connected to the second analogue signal receiving section 31 so that a signal about a pressure detected by the pressure sensor is inputted into the micom 34 while the engine is operated for a predetermined time period. Also while the engine is operated, the analogue signal inputted into the micom 34 from the pressure sensor is successively digitalized and calculated to obtain the pressure of the cylinder. Since the engine is rotated at a rate of about 400 RPM, the pressure is measured for about 10 through 400 RPM to calculate the maximum and minimum values. The micom outputs the maximum and minimum values of the calculated values as digitalized values via the liquid crystal display section of the multiple test system so that the user can read the values. Therefore, the user can judge whether the cylinder has a normal compression value or not based upon the output values.

Figure 1B:
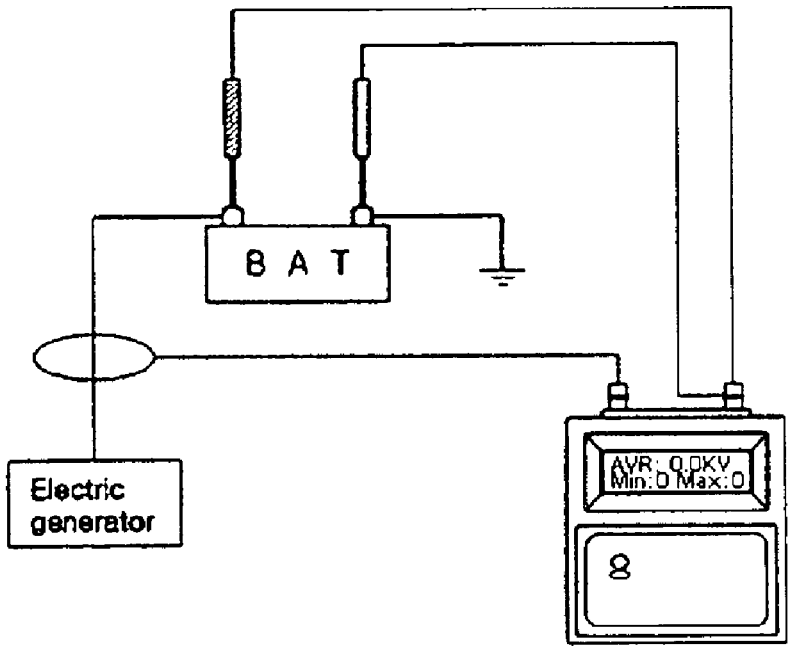
Figure 1C:
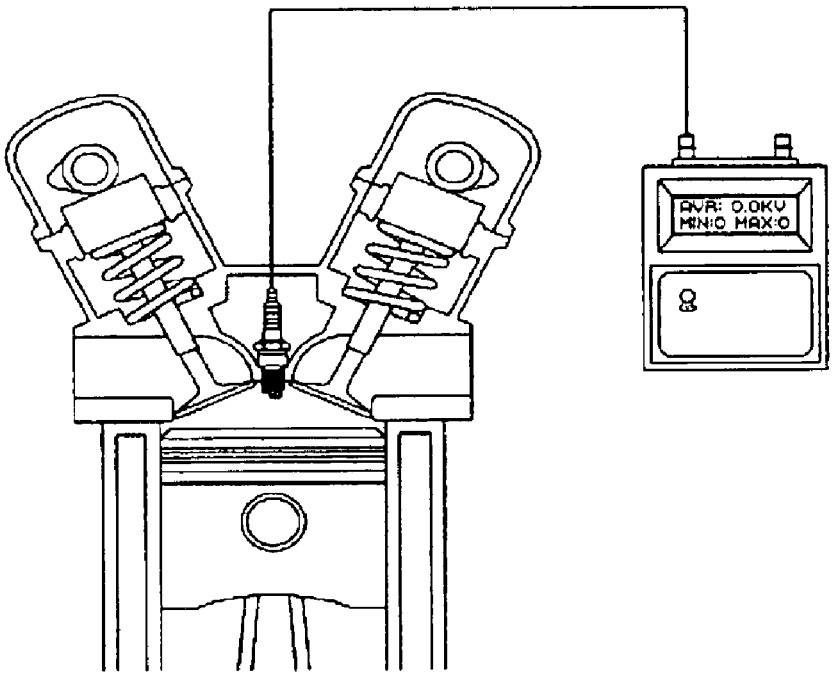

Further, the multiple test system can inspect current and voltage in the electric generator as shown in FIG. 1B. The Hall sensor is connected to the second analogue signal receiving section 30, which is connected to both ends of a battery BAT. An analogue signal about the voltage/current of the electric generator is detected by the Hall sensor and then inputted into the non-inverting amplifier 32 for amplifying the signal. The voltage/current signal is processed and calculated in the micom 34 so that values about the voltage/current of the electric generator are presented via the liquid crystal display section. Those values presented via the liquid crystal display section are read to confirm the operating condition of the electric generator. If only the voltage is measured, the battery voltage is not uniform according to electric load. If only the current is measured, current generation is not detected without load. Therefore, both the voltage and the current are measured simultaneously to ensure correct inspection.

Figure 1D:
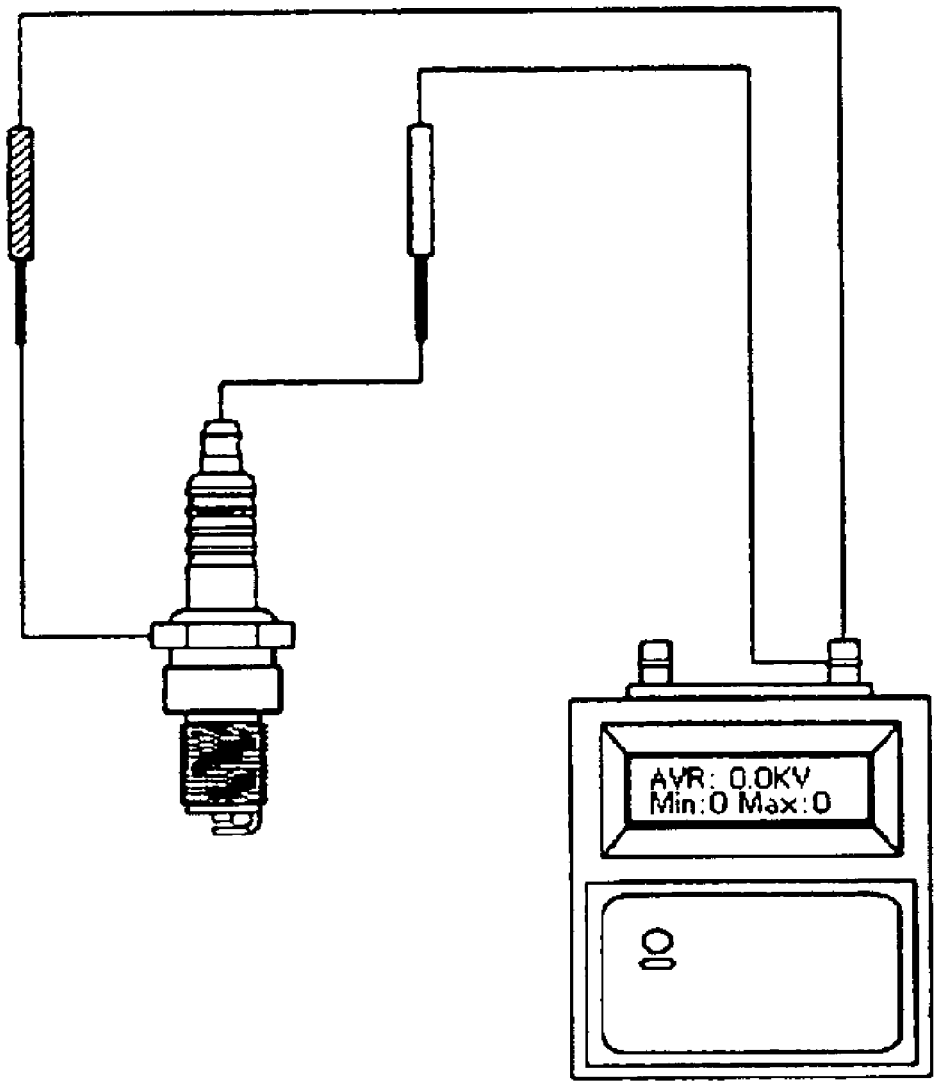

As shown in FIG. 1D, the first analogue signal receiving section is connected to the both ends of the ignition plug to measure the resistance of the ignition plug and presents the resistance value via the liquid crystal display section so that the user can confirm the resistance value. Such a method can be applied to measure general resistances as well as the resistance of the ignition plug.

As set forth above, the multiple test system of the invention is so constructed to measure the magnitude of high voltage, the engine RPM, the pressure within the cylinder, the resistance of the ignition plug and the current and voltage of the electric generator, in which the values are measured respectively according to setting of a measurement mode setting unit provided in the multiple test system.

The micom contains a system controlling program which controls input and output sections of the micom according to a set mode to carry out control and calculation according to a measurement mode.

The multiple test system of the invention comprises a power supply, the input section including the mode setting section and the liquid crystal display section for displaying the measured values.

Although the present invention has been shown and described with reference to the preferred embodiment thereof, the embodiment is illustrative only and the present invention is no event to be limited thereto. Rather, it will be understood by those skilled in the art that various changes in form and details may be made to the present invention without departing from the spirit and scope of the invention as defined by the appended claims.

As set forth above, the multiple test system of the invention is connected to a region of a vehicle to be measured to output the digitalized value via the liquid crystal display section so that the user can judge operating conditions of the vehicle such as ignition energy, RPM, the voltage/current of the electric generator, resistance and the compression pressure of the cylinder. Therefore, the user can simply inspect the vehicle, and after inspection, replace any aged component at a proper time point to ensure a normal operation to the vehicle.

What is claimed is:

1. A multiple test system for use in vehicles for measuring characteristics of an engine including an Electronic Control Unit (ECU), a power transistor and an ignition coil, comprising:

first and second analogue signal receiving sections each for receiving an input signal in the form of a high voltage waveform, which is generated from an ignition plug, through a connection channel of an external signal;

a non-inverting amplifier for amplifying a first analogue signal inputted from the first analogue signal receiving section;

a comparator for comparing a reference voltage, which is set by applying a predetermined value of voltage, with a second analogue signal inputted from the second analogue signal receiving section;

a microcomputer having a program for converting the analogue signal generated from the non-inverting amplifier into a first digital signal, converting the second analogue signal into a second digital signal based upon an output signal from the comparator, applying the reference voltage to the comparator, and controlling the system according to calculation and measurement modes of the converted digital signals; and a liquid crystal display section for displaying measurements outputted from the microcomputer section.

2. The multiple test system as set forth in claim 1, wherein the second analogue signal receiving section is connected to a Hall sensor, wherein the Hall sensor is arranged in a cable connected to the ignition coil for measuring a high voltage inputted into the ignition plug, wherein the comparator compares an analogue signal inputted from the Hall sensor with the reference voltage to generate a square wave if the analogue signal is larger than the reference voltage, and wherein the microcomputer is synchronous with the square wave to convert the high voltage analogue waveform signal, which is inputted into the microcomputer, into a digital signal in order to obtain ignition energy through detection and calculation.

3. The multiple test system as set forth in claim 2, wherein a period of the square wave signal, which is inputted into the microcomputer from the comparator, is measured to calculate the rotation speed of the engine.

4. The multiple test system as set forth in claim 2, wherein conversion of a high voltage analogue waveform signal, which is inputted into the microcomputer, into a digital signal is performed ten times to calculate maximum, minimum and mean values of the high voltage.

5. The multiple test system as set forth in claim 1, wherein the first analogue signal receiving section is connected to both ends of a battery, wherein the Hall sensor is connected to the second analogue signal receiving section, wherein the Hall sensor is arranged in a wire connecting between an electric generator and the battery to detect a voltage outputted from the electric generator, wherein the voltage of the battery is supplied to the non-inverting amplifier, and wherein the microcomputer measures the voltage/current of the electric generator based upon the signals inputted from the non-inverting amplifier and the Hall sensor.

6. The multiple test system as set forth in claim 1, wherein the second analogue signal receiving section is connected to both ends of the ignition plug, wherein the ignition plug has a pressure sensor attached thereto, for measuring the compression pressure within a cylinder, and wherein the microcomputer successively converts analogue values measured in the pressure sensor into digital values during rotation of the engine, and calculates and outputs maximum and minimum values of the converted pressure values.

7. The multiple test system as set forth in claim 1, wherein the first analogue signal receiving section is connected to both ends of the ignition plug to measure resistances of the ignition plug and other electric resistances.

* * * * *